United States Patent [19]

Sewell et al.

[11] 4,421,259

[45] Dec. 20, 1983

[54] METHOD AND APPARATUS FOR HANDLING HOSIERY

[75] Inventors: James H. Sewell, Charlotte, N.C.; Hans Gaede, Fort Mill, S.C.; Curtis R. Ritch, High Point, N.C.

[73] Assignee: Intech Corporation, Charlotte, N.C.

[21] Appl. No.: 250,636

[22] Filed: Apr. 3, 1981

[51] Int. Cl.[3] ..... D06C 5/00

[52] U.S. Cl. ..... 223/76; 223/112

[58] Field of Search ..... 223/61, 75, 76, 77, 223/112

[56] References Cited

U.S. PATENT DOCUMENTS

| | | | |
|---|---|---|---|
| 1,190,119 | 7/1916 | Coulston . | |
| 1,348,922 | 8/1920 | Ash | 223/76 |
| 1,472,978 | 11/1923 | Hanes | 223/76 |
| 1,560,415 | 11/1925 | Dennison . | |
| 1,669,251 | 5/1928 | Kienel | 223/76 |
| 1,897,886 | 2/1933 | Brand et al. | 223/76 |
| 2,154,369 | 4/1939 | Wanamaker | 223/75 |
| 2,166,053 | 7/1939 | Heliot | 223/112 |
| 2,221,669 | 11/1940 | Brewin . | |
| 3,103,302 | 9/1963 | Minton | 223/75 X |
| 3,345,732 | 9/1967 | Glaze, Jr. | 223/75 |

*Primary Examiner*—Louis Rimrodt

*Attorney, Agent, or Firm*—Schuyler, Banner, Birch, McKie & Beckett

[57] ABSTRACT

A method and apparatus (12) for handling hosiery is disclosed. A generally flat form (14) dimensioned to be inserted into hosiery is supported for motion on a conveyor chain (18). The form (14) is driven by a loading station (34) where hosiery is placed upon the form (14). A clamp mechanism (46) is carried on the form (14) for vertical motion along its length. The form (14) is thereafter moved past an elevator mechanism (16). The elevator mechanism (16) moves the clamp mechanism (46) upward until t contacts a bottom portion of the hosiery on the form and moves the bottom portion of the hosiery upward. Clamp jaws (52) of the clamp mechanism (46) thereafter clamp down on the hosiery placed on the form (14). After the jaws (52) have been clamped on the hosiery, the clamp mechanism (46) is forced downwardly by a cam plate (202).

39 Claims, 9 Drawing Figures

METHOD AND APPARATUS FOR HANDLING HOSIERY

TECHNICAL FIELD

The present invention relates to the field of hosiery manufacture. More particularly, the present invention relates to a method and an apparatus for handling hosiery during processing, for example during drying and/or setting.

BACKGROUND OF THE INVENTION

In hosiery processing, the hosiery must frequently be carried through various processing stations, such as drying, shaping, or inspection stations. During the processing, the hosiery, such as socks or stockings, is carried on shaped forms.

During a drying process, the hosiery may be held or clamped to the form to prevent shrinkage beyond a desired degree. In current prior art devices, the hosiery is manually positioned on a form to a particular length and thereafter clamped. This method of clamping is somewhat time consuming and relatively inaccurate. As a result, hosiery frequently exits the drying process in non-uniform lengths. The hosiery thereafter must be manually sorted and paired. Such an additional step is also both time consuming and expensive.

SUMMARY OF THE INVENTION

The present invention relates to a method and an apparatus for handling hosiery and the like during processing. The method includes the steps of placing a piece of hosiery on a form; moving a clamp mechanism upward along the length of the form until a portion of the clamp mechanism contacts and moves a bottom position of the hosiery upward with clamp jaws of the clamp mechanism in an open position; closing the clamp jaws after the bottom portion of the hosiery has been moved upward; and moving the closed clamp jaws and the hosiery held thereby downward.

The apparatus is comprised of a form dimensioned to be inserted into hosiery and supported for motion to carry the hosiery during processing. A clamp means is carried with the form and is movable upward and downward along the length of the form, and between a clamped position to secure the hosiery to form and an unclamped position. A means discrete from the form raises the clamp means to a desired height. A clamp actuating means is provided for moving the clamp means between its unclamped and clamped positions. The clamp actuating means is correlated with the stop means and the clamp raising means to move the clamp to its clamped position after the clamp has contacted a bottom of hosiery placed on the form and moved the bottom of the hosiery upward a distance.

In a preferred embodiment, the stop means is vertically adjustable to stop the raising means at any one of a plurality of heights. The clamp means includes a clamp body and a pair of clamp jaws pivotable between open and closed positions. The clamp body has an upper surface for contacting a bottom of hosiery placed on the form and the clamp jaws each have a contact edge for contacting the hosiery placed on the form. The contact edge is disposed above the upper surface of the clamp body when the clamp jaws are in their closed position.

A means is provided for camming the clamp means downward after the clamp jaws have pivoted to the closed position onto hosiery placed on the form. Thus, after the clamp means has pushed the bottom edge of hosiery on the form upward a slight degree and clamped the bottom edge, the clamped hosiery is pulled or cammed downward a predetermined amount by the camming means. In this manner, the hosiery need not be placed precisely on the form. Rather, if the hosiery is placed only approximately at a proper position, the clamp mechanism of the present invention will move it upward to a precise desired location and, thereafter, pull the hosiery down a precise amount to hold the sock at exactly the desired position. Precise manual alignment of the hosiery on the form is not required. The need for manual assortment of the hosiery after drying is also eliminated.

Various advantages and features of novelty which characterise the invention are pointed out with particularity in the claims annexed hereto and forming a part hereof. However, for a better understanding of the invention, its advantages, and objects attained by its use, reference should be had to the drawings which form a further part hereof and to the accompanying descriptive matter, in which there is illustrated and described a preferred embodiment of the invention.

DETAILED DESCRIPTION OF THE INVENTION

Figure 1:
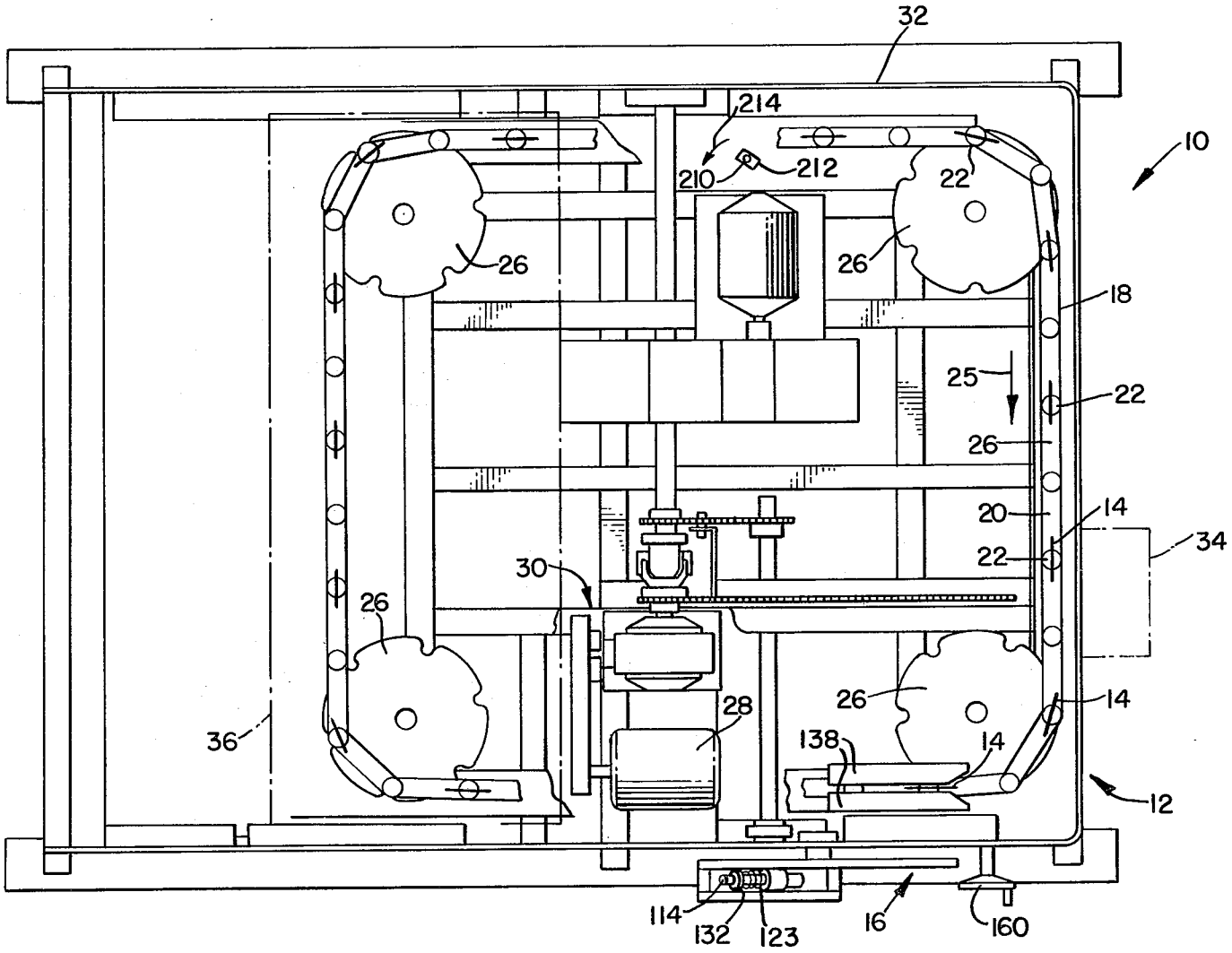
FIG. 1 is a diagramatic top plan view of a hosiery processing machine.

Referring to the drawings in detail, wherein like numerals indicate like elements, there is shown in FIG. 1 a hosiery processing machine designated generally as 10. A hosiery handling apparatus is designated generally as 12. The hosiery handling apparatus 12 includes a movable form 14 and a lifter or elevator mechanism 16. The form 14 is movably supported on a driven conveyor chain 18. The conveyor chain 18 is made up of a plurality of links 20 pivotably connected to one another. A collar 22 is attached to some of the links 20. A pin 24 extends downward from the bottom of each form 14 and is received within one of the collars 22. The forms 14 thus extend vertically upward and are conveyed in a horizontal direction indicated by arrows 25 by the chain 18. The conveyor chain 18 is trained about a plurality of gears 26, one of which is driven by a conventional power source. The conventional power source includes an electric motor 28 and a transmission 30. Since the motor and transmission 28, 30 are of conventional design, they will not be discussed in detail. The hosiery processing machine 10, including the gears 26, conveyor chain 18, electric motor 28 and transmission 30 are supported on a frame 32.

The conveyor chain 18 carries the forms 14 past a loading station 34, past the elevator mechanism 16, which serves as a clamping station, and through a further processing section, such as a dryer shown in phantom line as 36. Hosiery such as socks, stockings or the like, are manually placed on the forms 14 at the loading station 34. A sock 35 is shown on the form 14. Hosiery carried on the form is securred or clamped thereto at the clamping station. The hosiery is thereafter carried on the form 14 through the dryer 36. After leaving the dryer 36 the clamp is released and the hosiery is manually removed from the form.

Figure 3:
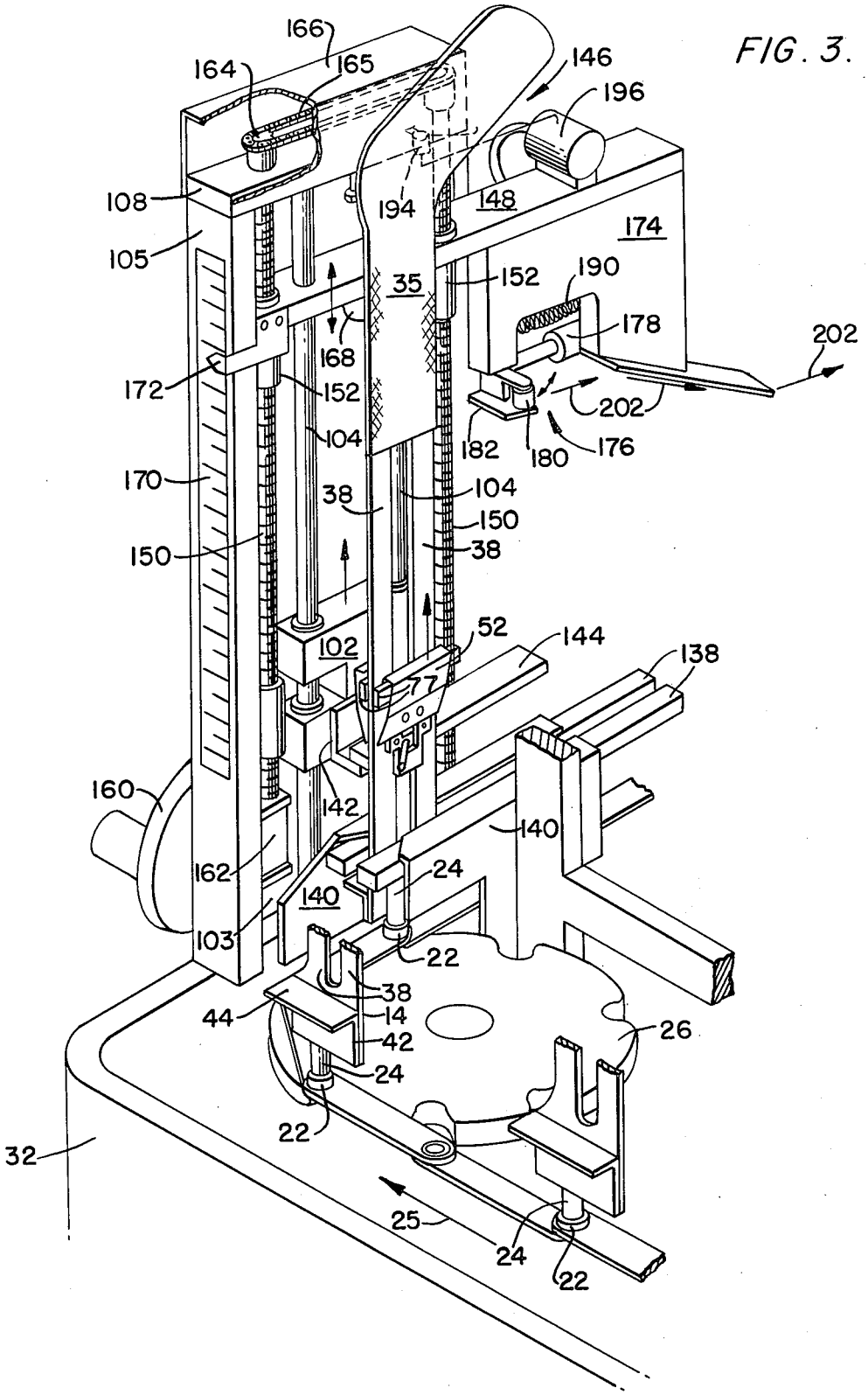
FIG. 3 is an enlarged perspective view illustrating the hosiery form, clamp and clamp raising mechanism.
Figure 6:
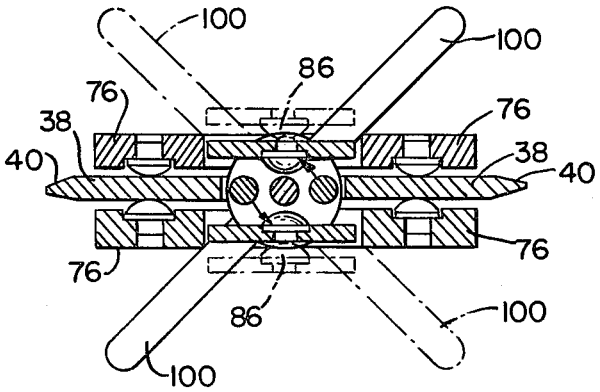
FIG. 6 is a sectional view taken generally along lines 6—6 of FIG. 4.

The form 14 has a generally flat body formed on any suitable material, such as light weight metal or plastic. The form 14 is preferably made of a single piece of material with an upper end shaped to conform to the shape of the hosiery to be held on the form 14. The medial portion of the form 14 has a slot formed through it to define a pair of space parallel upwardly extending flat plates 38 with their upper and lower ends joined. As best seen in FIG. 6, the outer edges 40 of the plates 38 are bevelled to avoid sharp corners. An angle plate 42 including a horizontally extending section 44 is attached at the lower end of form 14 (FIG. 3). The pin 24 is attached to and extends downward from the lower end of the form 14.

Figure 4:
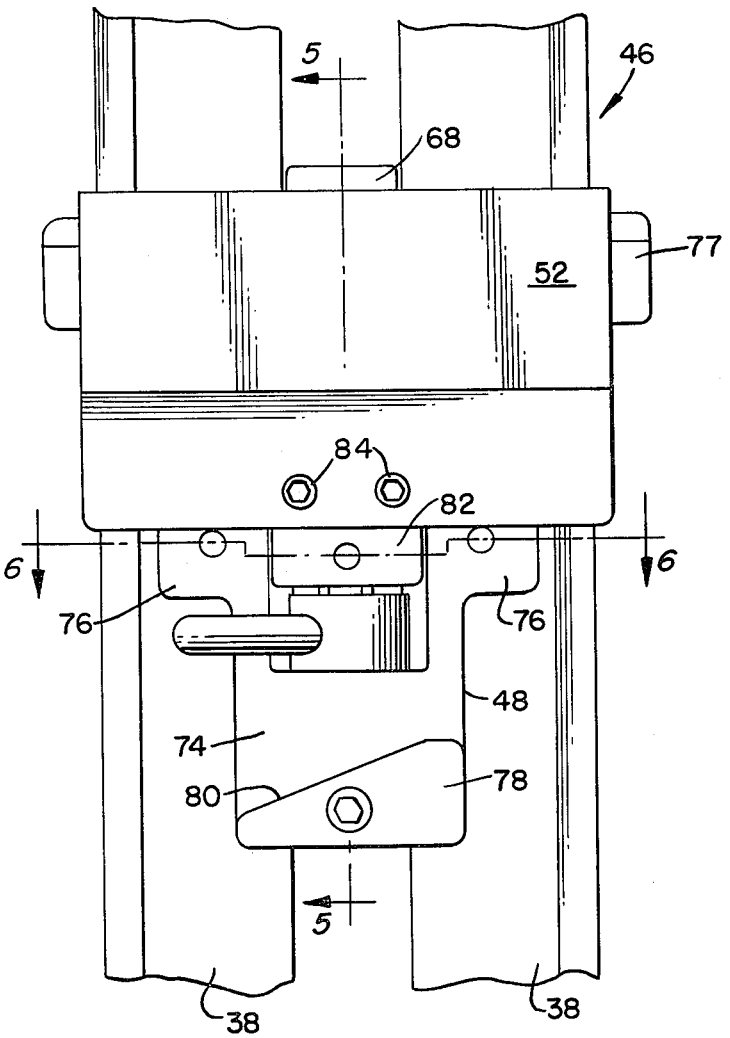
FIG. 4 is an enlarged elevational view of a portion of the form and clamp.
Figure 5:
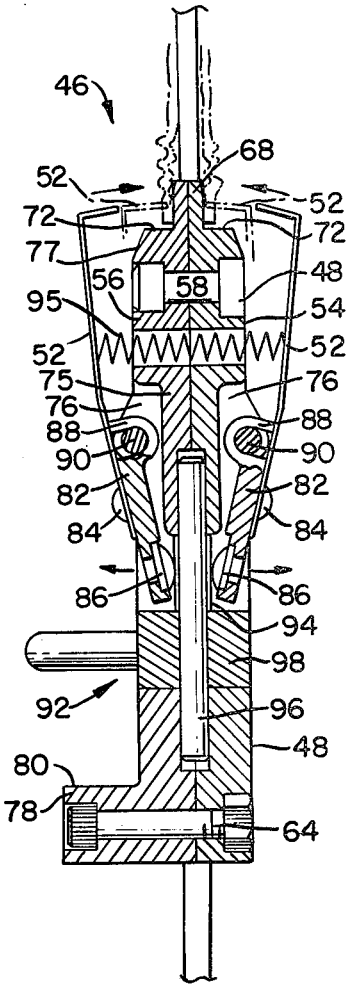
FIG. 5 is a sectional view taken generally along line 5—5 of FIG. 4.

A clamp mechanism 46, shown in detail in FIGS. 4, 5 and 6, is slidably carried on the form 14. The clamp mechanism 46 includes a clamp body 48, and a pair of clamp jaws 52 pivotably connected to the clamp body 48. The clamp body 48 is made up of a pair of like facing members 54, 56 connected to one another by a screw 58 and by a nut and bolt assembly 64. The clamp body 48 includes a base section 74, a pair of upwardly extending side sections 76 about each face of each plate 38, a central section 75 and upper cross bar 77 extending between side sections 76. A pair of generally horizontal ledges 72 form the top of the bars 77 and a ridge 68 extends upwardly therefrom in the area between plates 38. The horizontal ledges 72 form upper contact surfaces for contacting a lower end of the sock 35 placed on the form 14. A flange 78 extends outward from the lower portion of one face of the base section 74 and has an upwardly facing, slanted camming surface 80.

Each clamp jaw 52, preferably made of a spring type metal, is attached to a support plate 82 by a pair of screws 84. A wear or contact button 86 is connected to the lower end of each support plate 82 and has a contact surface facing inwardly. Each support plate 82 has a hooked upper end 88 forming an opening for the reception of a support pin 90. Each support pin 90 extends between a pair of associated side sections 76 and is received within aperatures of the side sections 76. The support plate 82 is supported within a recessed area of the clamp body 48 between the side section 76. The clamp jaws 52 are thus supported for pivotable motion about the pins 90.

An eccentric assembly 92 pivots the jaws 52 between the open position shown in full line in FIG. 5 and the closed position shown in phantom line in FIG. 5. The eccentric assembly 52 includes an eccentrically shaped collar 94 connected to a rotatable pin 96 for rotation therewith. The lower end of the pin 96 is received with an opening in the base section 74 of the clamp body 48 and the upper end of the pin 96 is received within an opening in the central section 75 of the clamp body 48. A support cylinder or block 98 is fixed to the pin 96 for rotation with it and is supported above the base section 74. An actuator arm 100 extends outward of the block 98 at 180° intervals. An arm 100 thus extends outward from the face of each jaw 52. As will be explained more fully hereinafter, the arms 100 are actuated externally to rotate the eccentric collar 94 and, thereby, pivot the jaws 52. That is, as the broader portion of the eccentric collar 94 rotates into contact with the button 86, the jaws 52 pivot closed. As the narrower portion of the eccentric collar 94 rotates into contact with the buttons 86, the jaws 52 pivot open under a gravity bias or under the bias of spring 95 which extends through an opening through the clamp body 48.

Figure 2:
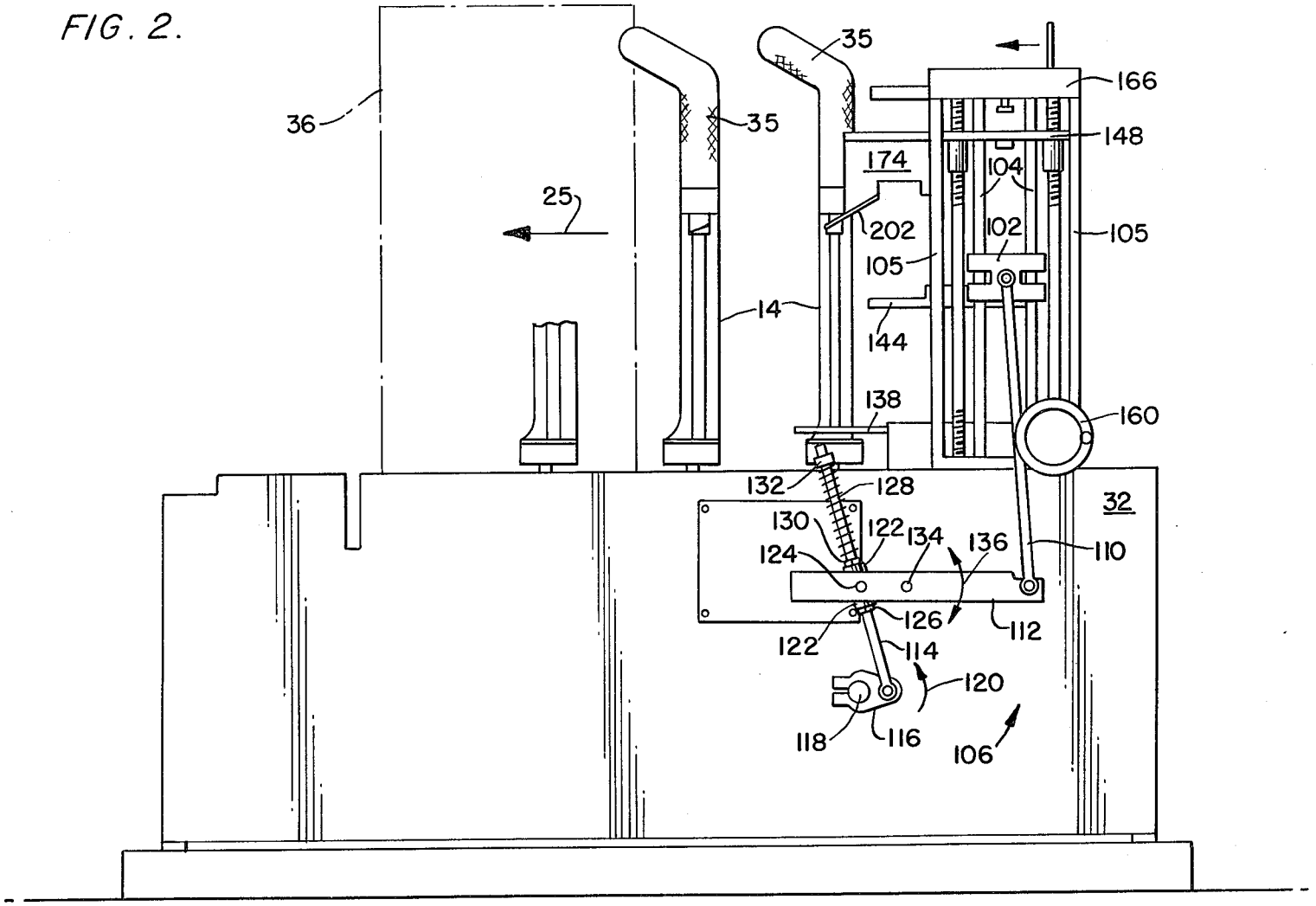
FIG. 2 is a side elevational view illustrating the clamp raising mechanism.
Figure 7:
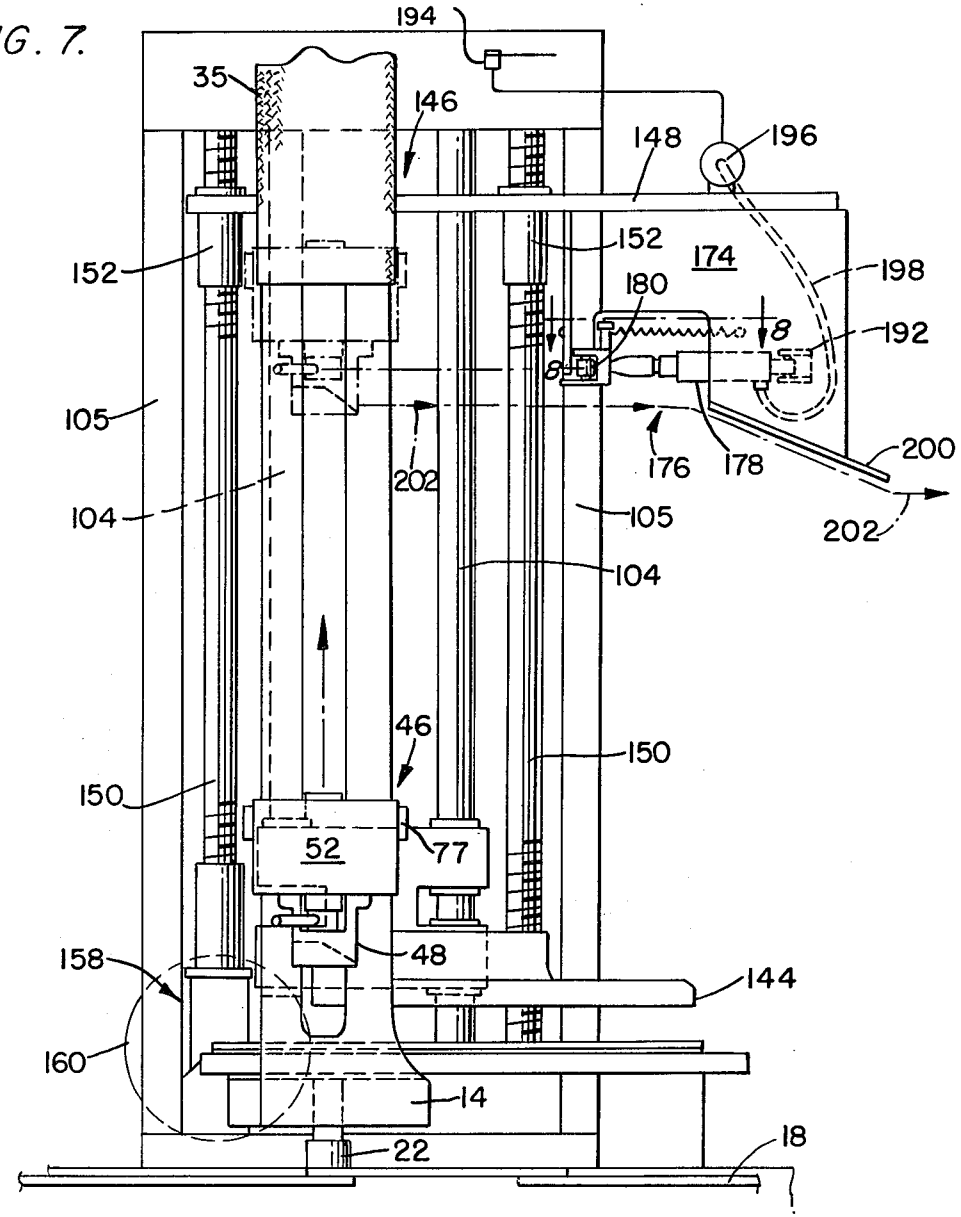
FIG. 7 is an elevational view of the form, clamp and clamp raising mechanism.

Details of the elevator mechanism 16 can best be seen in FIGS. 2, 3 and 7. The elevator mechanism 16 includes a generally H-shaped slide block or member 102 supported for sliding motion along a pair of spaced parallel, vertically extending slide shaft 104. The block 102 is moved upwardly and downwardly along the shafts 104 by a drive assembly 106. The lower ends of the shafts 104 are connected to a base 103, which is supported on the frame 32, and their upper ends are connected to an upper support bar 108. A pair of spaced, vertically extending upright members 105 are connected to and extend between the base 103 and the upper support bar 108.

The drive assembly 106 includes a push rod 110, an actuator or lever arm 112, a coupling shaft 114, a crank 116, and a drive shaft 118. The drive shaft 118 is coupled to the transmission 30 so that the upward and downward motion of the slide 102 is coordinated to the drive of the chain 18 and, hence, to the motion of the forms 14 past the clamping station.

The drive shaft 118 and attached crank 116 are rotated in the direction of arrow 120. The lower end of coupling shaft 114 is pivotably connected to an outer portion of the crank 116 so that it revolves about the axis of shaft 118. The shaft 114 extends upwardly from its connection to the crank 116 through a hollow swivel housing 122 and for a distance thereabove. The swivel housing 122 is generally a hollow tube and is pivotably connected to the actuator arm 112 by bearings 124. A set collar 126 is fixed to the shaft below the swivel housing 122 and a compression spring 128 is received about the shaft 114 above the arm 112. The spring 128 is held about the shaft 114 between a lower retaining collar 130 and an upper retaining collar 132. The retaining collars 130, 132 are removably fixed in position on the coupling shaft 114.

The actuator arm 112 pivots about a bearing or pin 134 connected to the frame 32. The actuator arm 112 pivots upwardly and downwardly in the direction indicated by arrows 136. The lower most end of the push rod 110 is pivotably connected to an end of the actuator arm 112, and the upper end of the push rod 110 is pivotably connected to the center of the slide block 102. The upperward and downward pivoting of the actuator arm 112 thus moves the slide block 102 upwardly and downwardly along the slide shafts 104. The shaft 114 is not fixedly connected to the swivel housing 122. To cause downward pivoting motion of the right side of the actuator arm 112 (as viewed in FIG. 2) the set collar 126 contacts the button swivel housing 122 and serves as an abutment to push the left end of the actuator arm 112 upward about the axis of bearing 134 as the rotation of the crank 116 moves the coupling shaft 114 upward. During the downward motion of the shaft 114, its position relative to the actuator arm 112 is fixed by the compression spring 128 as long as the slide block 102 is free to move upward along the slide shafts 104. As will be explained more fully hereinafter, a stop mechanism is provided for stopping the upward motion of the slide block 102 at various vertical heights less than the maximum height to which the push rod 110 can move the block 102. When the stop mechanism prevents the block 102 from moving to its maximum height, the rod 114 continues to be pulled downward through the swivel housing 122 against the force of compression spring 128. As this occurs, the push rod 110 and the actuator arm 112 are prevented from moving by the stop mechanism.

As seen in FIG. 3, the lower end of a form 14 is guided past the elevator mechanism 16 between a pair of spaced parallel guide blocks 138. Each guide block 138 is attached to the frame 32 by an extended angle bracket 140. A flange 142 is attached to the front face of the bearing block 102 and has an extended horizontal support surface 144. As the form 14 passes the slide block 102, the lower surface of the flange 78 slides over the support surface 114. As the slide block 102 is driven upward, the clamp mechanism 46 is carried upward while the form 14 still proceeds to move past the clamping station.

A stop mechanism, designated generally as 146, stops the upward motion of the slide block 102 at any of a plurality of vertical locations. The stop mechanism 146 includes a generally horizontally disposed cross bar 148 coupled to a pair of spaced parallel, vertically extending lead screws 150. A pair of lead nuts 152 are mounted within holes in the cross bar 148 and are received about the lead screws 150. Rotation of the lead screws 150 will raise or lower the lead nuts 152 and the attached cross bar 148. The lead screws 150 extend between the base 103 and the upper support bar 108. One of the lead screws 150 is rotatably carried by bearings in the base 103 and upper support member 108. The other lead screw is rotatably carried by a bearing in the upper support member 108 and a manual actuator 158 supported by the base 103.

The manual actuator 158 includes a rotatable hand wheel 160 connected to a conventional gear box 162. The gear box 162 in turn is connected to one of the lead screws 150. Thus, rotation of the hand wheel 160 is transmitted as rotary motion to one of the lead screws 150. To transmit the rotary motion of the one lead screw 150 to the other lead screw 150, a sprocket 164 is attached to the upper end of each lead screw 150 and a chain 165 is trained about the two sprockets 164. In this manner, the two lead screws 150 can be rotated in unison and the cross bar 148 can be evenly raised or lowered. A housing 166 is attached to the upper support member 108 and surrounds the sprockets 164 and the chain 165. A bumper 168 is attached to and extends downwardly from the bottom surface of the cross bar 148 in the area between the slide shafts 104. The bumper 168 is the contact point with the slide block 102. An indicator scale 170 is attached to the side of one of the upright members 105. A pointer 172 is attached to the cross bar 148 and extends around the upright member 105 and overlaps the face of the scale 170. The scale 170 is proportioned to indicate the lengths of hosiery to be clamped on the form 14 at a given vertical position of the stop mechanism 146.

Figure 8:
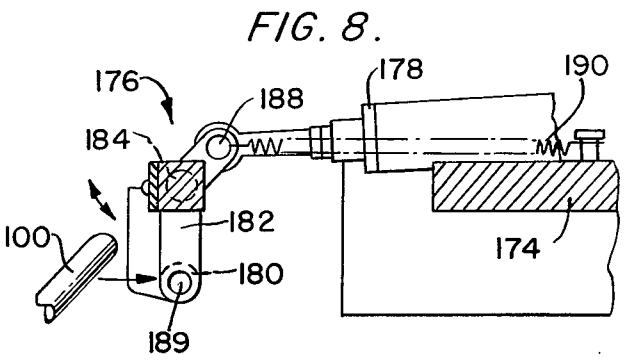
FIG. 8 is a sectional view taken generally along line 8—8 of FIG. 7.
Figure 9:
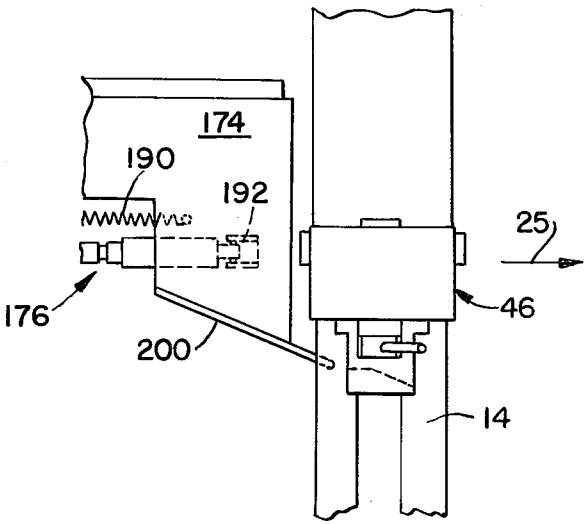
FIG. 9 is a partial elevational view illustrating the clamp after it has been cammed downward.

A support plate 174 is attached to and extends downwardly from the downstream end of the cross bar 148. An external clamp jaw actuator assembly 176 is attached to the support plate 174. The actuator assembly 176 includes an air cylinder 178 and a contact roller or bumper 180. A bumper retainer 182 is pivotably attached to the lower end of a leg of the support plate 174 by a pin or bearing 184. The retainer 182 has a generally C-shaped configuration facing in two directions. The contact bumper 180 is received within the open area of the general C-shape at one end of the retainer 182 and a rod end 186 of the air cylinder 178 is received within an open area of the general C-shape at the other end of the retainer 182. A coupling pin 188 connects the rod end 186 to the retainer 182 and a coupling pin 189 connects the bumper 180 to the retainer 182. A first end of a spring 190 is also connected to the pin 188. The other end of the pin 190 is connected to the support plate 174. A connection block 192 pivotably connects the other end of the air cylinder 178 to the support plate 174. The air cylinder 178 is a single acting cylinder. When pressurized air is supplied to the cylinder 178, the rod end 186 extends outwardly against the bias of spring 190. This motion pivots the retainer 182 in a counter-clockwise direction as viewed in FIG. 8. When the rod end 186 is fully extended and the retainer 182 is thus pivoted, the bumper 180 is moved out of the path of the pin 100. When no pressure is applied to the cylinder 178, the spring 190 holds the retainer 182 in the position shown in FIG. 8. In this position, the bumper 180 is in the path of pin 100 to actuate the closing of the clamp jaws 52.

A sensor, preferably in the form of a resistant sensor 194 is attached to the housing 166. The sensor 194 is connected to a solenoid valve 196 which controls the flow of pressurized air to the cylinder 178 through tubing 198. The form 14 is preferably made of a metalic material. When a sock is not on the form 14 and the form 14 is constructed of metal, a circuit is completed through the resistance sensor 194 when the form 14 comes in contact with a contact finger of the sensor 194. With the circuit complete, the solenoid valve 196 applies pressurized air to the cylinder 178 to retract the bumper 180 out of the path of the pin 100. Thus, the clamp jaw will not clamp down upon bare metal of the form 14. If a sock is present on the form 14, the circuit is not completed and the bumper 180 remains in the path of the pin 100 under the bias of spring 190.

A cam plate 200 is attached to the downstream most end of the support plate 174. As the form 14 moves past the clamping station, the lower surface of the flange 78 leaves contact with the support surface 144 and the upper camming surface 80 comes into contact with the lower surface of the cam plate 200. As indicated by arrows 202, the cam plate 200 forces the clamp mechanism 46 downward to thereby move the sock to its desired length. The amount of motion or stretching is accurately controlled by the cam plate 200.

A method of handling hosiery, in accordance with the present invention, and the manner of operating the hosiery handling apparatus 12 are as follows. A piece of hosiery, such as sock 35 is manually placed on the form 14 at a loading station 34. For a given length, the sock should be manually aligned on the form within plus or minus one inch of a set point. As will be explained hereinafter, this relatively imprecise locating of the sock 35 is corrected or adjusted automatically by the manner in which the sock 35 is clamped to the form 14. After leaving the loading station 34, the form 14 is carried by the conveyor chain 18 to the elevator mechanism 16. At the elevator mechanism 16, the lower surface of the flange 78 comes in sliding contact with the support surface 144, as the drive chain 18 continues to move the form 14. The drive assembly 106 of the slide block 102 is coordinated with the drive of the chain 18 so that the support surface 144 is aligned with the lower surface of the flange 78 as a form 14 approaches it. As the flange 78 slides over the support surface 144, the drive assembly 106 moves the slide block 102, and, hence, the clamp mechanism 46 upwardly.

The stop mechanism 146 has been preset for the particular length of socks being placed on the form 14 by turning the hand wheel 160 until the pointer 172 is aligned with the particular length indicated on the scale 170. With the sock 35 only approximately located on the form 14 for a given length, the clamp jaws 52 will clamp down on only small amount of material gathered upon the ledges 72 above clamp surface of jaw. If the sock has been pulled down too far, excess material will gather above the ledges 72 and not be held by the clamp jaws 52. After the clamp mechanism 46 has been moved upwardly to its maximum intended extent and the bottom of the sock on the form has been contacted and moved upward, the clamp jaws are pivoted to their closed position. As seen in FIG. 3, the clamp jaws 52 are open and the pin 100 is in its clockwise most position as the clamp mechanism 46 is moved upward. As the pin 100 is moved past the bumper 180 by the continued motion of the form 14 on chain 18, it is rotated to its counterclockwise most position and the eccentric shaped collar 94 rotates so that its thickest portion abuts the wear buttons 86 to pivot the clamp jaws 52 to their closed position.

As the flange 78 leaves contact with the support surface 144, the upper camming surface 80 of the flange 78 contacts the bottom of cam plate 200 and the clamp mechanism 46 are forced downwardly a set amount, i.e., to the lower most end of the cam plate 200. The bottom of the sock held by the clamp jaws 52 is thereby moved downwardly a set amount. The clamp jaws 52 are of a spring type metal and frictionally hold the clamp mechanism 46 to the sock form 14 without sliding downward. The sock is held at an accurate position, even if the sock is only approximately located on the form 14 because of the upward pushing of the sock by the clamp mechanism 46, followed by the clamping of a small portion of the sock and the pulling downward of the sock by the camming action of the cam plate 200. The form 14 thereafter is passed through further processing stations, such as dryer 36. After leaving the dryer 36 the opposite end of pin 100 comes in contact with a release bumper to pivot the jaws 52 to the open position so that the sock may be removed from the form 14 and the clamp mechanism 46 drops to its lowermost position. The release bumper is preferably in the form of a vertically extending rod 210. The rod 210 is held between a pair of arms 212 (one of which is shown) and is pivotable in the direction of arrow 214.

Numerous characteristics and advantages of the invention have been set forth in the foregoing description together with details of the construction and function of the invention. The novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

We claim:

1. An apparatus for handling hosiery and the like during processing comprising:

a form dimensioned to be inserted into hosiery and supported for motion to carry the hosiery during processing;

clamp means carried with said form, said clamp means being movable upward and downward along the length of said form and between a closed position to secure hosiery to said form and an open position;

mechanical means discrete from said form for raising said clamp means to a desired height; and mechanical clamp actuating means for moving said clamp means between its open and closed positions, said mechanical clamp actuating means being correlated with said mechanical clamp raising means to move said clamp means to its closed position after said clamp means has contacted a bottom of hosiery placed on said form and moved the bottom of the hosiery upward a distance.

2. An apparatus in accordance with claim 1 including a stop means for stopping said raising means when said clamp means reaches the desired height.

3. An apparatus in accordance with claim 2 wherein said stop means is discrete from said raising means and is adjustable to stop said raising means at any one of a plurality of vertical locations.

4. An apparatus in accordance with claim 2 or 3 wherein said clamp means includes a clamp body and a pair of clamp jaws pivotable between the open and closed positions, said clamp body having an upper surface for contacting a bottom of hosiery placed on the form, and said clamp jaws each having a contact edge for contacting the hosiery placed on said form, said contact edge being disposed above the upper surface of said clamp body when said clamp jaws are in their closed position.

5. An apparatus in accordance with claim 4 wherein said clamp actuating means is correlated to said stop means and said clamp raising means to move said clamp jaws to the closed position after said upper surface of said clamp body contacts the bottom of the hosiery placed on the form and moves the bottom of the hosiery upward a distance.

6. An apparatus in accordance with claim 5 including means for camming said clamp means downward after said clamp jaws have pivoted to their closed position onto hosiery placed on said form.

7. An apparatus in accordance with claim 5 wherein said clamp jaws are pivotable about generally horizontal axes and include lower portions extending below said axes, said clamp actuating means including an eccentric member rotatable about a generally vertical axis and having an eccentric shaped surface for contacting the lower portions of said jaws to pivot said jaws about their axes by rotation of said eccentric member about its axis.

8. An apparatus in accordance with claim 7 wherein said form is movable along a path, said clamp actuating means including an actuator arm connected to and extending from the axis of said eccentric member and an actuator stop disposed along a path of said form for contacting said actuator arm and rotating said eccentric member as said form is moved past said actuator stop.

9. An apparatus in accordance with claim 8 wherein said actuator stop is movable between an operative position to contact said actuator arm and an inoperative position wherein said actuator arm will not contact said actuator stop.

10. An apparatus in accordance with claim 9 including sensor means for detecting the presence and absence of hosiery on said form and means for moving said actuator stop between its operative and inoperative positions, said actuator stop moving means being controlled by said sensor means to move said actuator stop to its operative position when hosiery is on said form and to move said actuator stop to its inoperative position when no hosiery is on said form.

11. An apparatus in accordance with claim 8 wherein said actuator stop is connected to said stop means to be raised and lowered therewith.

12. An apparatus in accordance with claim 11 including a cam plate connected to said stop means to be raised and lowered therewith for camming said clamp means downward after said clamp jaws have pivoted to their closed position onto hosiery placed on said form.

13. An apparatus in accordance with claim 2 or 3 wherein said form is movable past said raising means, said raising means including a slide member connected to a vertical support structure for upward and downward motion, said slide member including a coupling plate for connecting said clamp means to said slide member as said clamp means moves by said side member, and drive means for moving said slide member upward and downward.

14. An apparatus in accordance with claim 13 wherein said drive means can raise said slide member to a predetermined maximum height and wherein said stop means includes a stop member positionable at any one of a plurality of vertical positions below said predetermined maximum height, said drive means including motion absorbing means for absorbing driving motion of said drive means when said stop member stops said slide member below said predetermined maximum height.

15. An apparatus in accordance with claim 13 wherein said drive means includes a push rod pivotably connected to said slide member and a driven crank mechanism connected to said push rod, said crank mechanism including a lever arm, a coupling shaft, a drive shaft and a crank, said drive shaft being connected to a driving power source, said crank being connected to and rotated by said drive shaft, a first end of said coupling shaft being pivotably connected to said crank at a location spaced from the axis of rotation of said drive shaft, another portion of said connecting arm being pivotably coupled to said lever arm at location spaced from the connection between said lever arm and said push rod, said lever arm being supported for pivoting about an axis between the point of coupling to said coupling shaft and the point of connection to said push rod.

16. An apparatus in accordance with claim 15 wherein said stop means includes a stop bar supported above said slide member and means for setting said stop bar at any one of a plurality of vertical locations, said stop bar contacting said slide member to stop the upward motion of said slide member and said coupling shaft absorbing excess motion of said crank mechanism if said slide member is stopped prior to reaching its highest point of travel.

17. An apparatus in accordance with claim 16 wherein said means for setting said stop bar includes a pair of horizontally spaced, vertically extending lead screws, a pair of lead nuts connected to said stop bar and coupled to said lead screws and means for rotating said lead screws to raise and lower said stop bar.

18. An apparatus in accordance with claim 16 wherein said coupling shaft has a first end pivotably connected to said crank, a swivel housing pivotably connected to said lever arm, said coupling shaft extending from said crank through said swivel housing to the other side of said lever arm and spring means connected between said coupling shaft and said swivel housing to hold said coupling shaft relative to said lever arm during normal driving motion of said crank arm during the upward motion of said slide member and to allow said coupling shaft to move relative to said lever arm when said stop bar stops the motion of said slide member prior to said slide member reaching its highest point of travel.

19. An apparatus for handling hosiery and the like during processing comprising:

a generally flat form dimensioned to be inserted into hosiery and supported for motion to carry the hosiery during processing;

a clamping station;

means for conveying said form past said clamping station;

clamp means carried by said form, said clamp means being movable upward and downward along the length of said form and between a clamped position to secure hosiery to said form and an unclamped position;

means disposed at said clamping station and discrete from said form for raising said clamp means to a desired height;

stop means for stopping the raising means when said clamp means reaches said desired height, said stop means being adjustable to stop said raising means at any one of a plurality of heights;

clamp actuating means for moving said clamp means from its unclamped to its clamped position after said raising means has raised said clamp means to a desired height; and means for moving said clamp means downward a predetermined distance after said actuating means has moved said clamp means to its clamped position.

20. An apparatus in accordance with claim 19 wherein said clamp means includes a clamp body and a pair of clamp jaws pivotable between open and closed positions, said clamp body having an upper surface for contacting a bottom of hosiery placed on said form, and said clamp jaws each having a contact edge for contacting the hosiery placed on said form, said contact edge being disposed above said upper surface of said clamp body when said clamp jaws are in their closed position, said clamp actuating means being correlated to said stop means and said clamp raising means to move said clamp jaws to the closed position after said upper surface of said clamp body contacts the bottom of the hosiery placed on the form and moves the bottom of the hosiery upward a distance.

21. An apparatus in accordance with claim 20 wherein said clamp jaws are pivotable about generally horizontal axes and include lower portions extending below said axes, said clamp actuating means including an eccentric member supported for rotary motion about a generally vertical axis by said clamp body and having an eccentric shaped surface for contacting the lower portions of said jaws to pivot said jaws about their axes by rotation of said eccentric member about its axis, an actuator arm connected to an extending from the axis of said eccentric member and an actuator stop disposed along the path of said form past said clamping station for contacting said actuator arm and rotating said eccentric member as said form is moved past said actuator stop.

22. An apparatus in accordance with claim 21 wherein said actuator stop is connected to said stop means to be raised and lowered therewith.

23. An apparatus in accordance with claim 22 wherein said actuator stop includes a movable bumper and means for moving said bumper between an operative position wherein said bumper is in the path of said actuator arm as it moves past said bumper and an inoperative position wherein said bumper is out of the path of said actuator arm as it moves past said bumper.

24. An apparatus in accordance with claim 23 including sensor means supported at said clamping station for detecting the presence and absence of hosiery on said form and for activating said bumper moving means to its inoperative position when hosiery is absent from said form.

25. An apparatus in accordance with claim 19 wherein said raising means includes a slide member connected to a vertical support structure for upward and downward motion, said slide member including a coupling plate for connecting said clamp means to said slide member as said clamp means moves by said slide member, and drive means for moving said slide member upward and downward.

26. An apparatus in accordance with claim 25 wherein said drive means includes a push rod pivotably connected to said slide member and a driven crank mechanism connected to said push rod, said crank mechanism including a lever arm, a coupling shaft, a drive shaft and a crank, said drive shaft being connected to a driving power source, said crank being connected to and rotated by said drive shaft, a first end of said coupling shaft being pivotably connected to said crank at a location spaced from the axis of rotation of said drive shaft, another portion of said coupling shaft being pivotably coupled to said lever arm at location spaced from the connection between said lever arm and said push rod, said lever arm being supported for pivoting about an axis between the point of coupling to said coupling shaft and the point of connection to said push rod.

27. An apparatus in accordance with claim 26 wherein said stop means includes a stop bar supported above said slide member and means for setting said stop bar at any one of a plurality of vertical locations, said stop bar contacting said slide member to stop the upward motion of said slide member and said coupling shaft absorbing excess motion of said crank mechanism if said slide member is stopped prior to reaching its highest point of travel.

28. An apparatus in accordance with claim 27 wherein said means for setting said stop bar includes a pair of horizontally spaced, vertically extending lead screws, a pair of lead nuts connected to said stop bar and coupling to said lead screws and means for rotating said lead screws to raise and lower said stop bar.

29. An apparatus in accordance with claim 27 or 28 wherein said coupling shaft has a first end pivotably connected to said crank, a swivel housing pivotably connected to said lever arm, said coupling shaft extending from said crank through said swivel housing to the other side of said lever arm and spring means connected between said coupling shaft and said swivel housing to hold said coupling shaft relative to said lever arm during normal driving motion of said crank arm during the upward motion of said slide member and to allow said coupling rod to move relative to said lever arm when said stop bar stops the motion of said slide member prior to said slide member reaching its highest point of travel.

30. An apparatus in accordance with claim 29 including an abutment on said coupling shaft below said lever arm to contact said swivel housing and pivot said lever arm in one direction, and wherein said spring means is a coil spring received about a portion of said coupling shaft extending above said lever arm and is held thereof between a pair of collars attached to said coupling shaft.

31. An apparatus in accordance with claim 19 wherein said means for moving said clamp means downward includes a cam plate connected to said stop means to be raised and lowered therewith for camming said clamp means downward after said clamp jaws have pivoted to their closed position onto hosiery placed on said form.

32. An apparatus in accordance with claim 31 wherein said clamp means includes a clamp body having an outwardly extending flange with an upwardly facing surface, said upwardly facing surface sloping downward at an angle mating with the slope of inclination of said cam plate.

33. An apparatus for handling hosiery and the like during processing comprising:

a generally flat form dimensioned to be inserted into hosiery and supported for motion to carry the hosiery during processing;

a clamping station;

means for conveying said form past said clamping station;

clamp means carried by said form, said clamp means being movable upward and downward along the length of the form, said clamp means including a pair of clamp jaws pivotably connected to a clamp body and pivotable between a clamped position to secure hosiery to said form and an unclamped position, said clamp body having an upper surface for contacting a bottom of hosiery placed on said form, and said clamp jaws having a contact edge for contacting the hosiery placed on said form, said contact edge being disposed above said upper surface of said clamp body when said clamp jaws are in their closed position;

means are disposed at said clamping station and discrete from said form for raising said clamp means to a desired height, said raising means including a slide member supported for vertical motion upon a pair of vertically extending support bars, and drive means for moving said slide member upwardly and downwardly along said vertical support bars, said slide member including a coupling plate for connecting said clamp body to said slide member as said clamp means passes said clamping station;

stop means for stopping the slide bar when said clamp means reaches said desired height, said stop means being adjustable to stop said slide member at any one of a plurality of heights, said stop means including a slide bar to which a pair of spaced lead nuts are coupled, a pair of spaced rotatable lead screws connected to said lead nuts and means for rotating said lead screws;

clamp actuating means for rotating said clamp jaws between their clamped and unclamped positions, said actuating means including a rotatable eccentric member supported by said clamp body, said eccentric member having an eccentric shaped surface for pivoting said jaws, an actuator stop carried with said stop bar for contacting an actuator arm extending from said eccentric member to rotate said eccentric member when said actuator arm passes by and contacts said actuator stop; and a downwardly sloping cam plate carried with said stop bar, said cam plate being disposed downstream of said coupling plate on said slide member, said cam plate contacting a downwardly sloping surface connected to said clamp body to move said clamp means downward after said clamp jaws have been pivoted to their clamped position.

34. An apparatus in accordance with claim 33 including means for moving said actuator stop out of the path of said actuator arm.

35. An apparatus in accordance with claim 34 wherein said actuator stop includes a bumper member for contacting said actuator arm, said bumper member being supported by a pivotable bracket, and wherein said actuator stop miving means includes an air-cylinder mechanism, a piston rod of said air-cylinder mechanism being connected to said pivotable bracket whereby the motion of said piston rod pivots said bracket to move said bumper into and out of the path of said actuator arm.

36. An apparatus in accordance with claim 35 wherein said form is comprised of a metalic material and including an electrical resistance sensor mounted in the path of said form past and clamping station, said sensor being connected to a solenoid to control the flow of pressurized air to said air-cylinder mechanism whereby said bumper member is moved out of the path of said actuator arm when said sensor detects the lack of hosiery on said form.

37. An apparatus for handling hosiery and the like during processing comprising:

a form dimensioned to be inserted into hosiery and supported for motion to carry the hosiery during processing;

clamp means carried with said form, said clamp means being movable upward and downward along the length of said form and between a clamped position to secure hosiery to said form and an unclamped position;

means discrete from said form for raising said clamp means to a desired height including a slide member connected to a vertical support structure for upward and downward motion, said form being movable past said raising means, said slide member including a coupling plate for connecting said clamp means to said slide member as said clamp means moves by said slide member, and drive means for moving said slide member upward and downward;

stop means for stopping said raising means when said clamp means reaches the desired height; and clamp actuating means for moving said clamp means between its unclamped and clamped positions, said clamp actuating means being correlated with said clamp raising means to move said clamp means to its clamped position after said clamp means has contacted a bottom of hosiery placed on said form and moved the bottom of the hosiery upward a distance.

38. An apparatus for handling hosiery and the like during processing comprising:

a form dimensioned to be inserted into hosiery and supported for motion to carry the hosiery during processing;

clamp means carried with said form, said clamp means being movable upward and downward along the length of said form and between a clamped position to secure hosiery to said form and an unclamped position;

means discrete from said form for raising said clamp means to a desired height including a slide member connected to a vertical support structure for upward and downward motion, said form being movable past said raising means, said slide member including a coupling plate for connecting said clamp means to said slide member as said clamp means moves by said slide member, and drive means for moving said slide member upward and downward;

adjustable stop means discrete from said raising means for stopping said raising means when said clamp means reaches the desired height at any one of a plurality of vertical locations; and clamp actuating means for moving said clamp means between its unclamped and clamped positions, said clamp actuating means being correlated with said clamp raising means to move said clamp means to its clamped position after said clamp means has contacted a bottom of hosiery placed on said form and moved the bottom of the hosiery upward a distance.

39. An apparatus for handling hosiery and the like during processing comprising:

a form dimensioned to be inserted into hosiery and supported for motion to carry the hosiery during processing;

clamp means carried with said form, said clamp means being movable upward and downward along the length of said form and between a closed position to secure hosiery to said form and an open position said, clamp means including a clamp body and a pair of clamp jaws pivotable between the open and closed positions, said clamp body having an upper surface for contacting a bottom of hosiery placed on the form, and said clamp jaws each having a contact edge for contacting the hosiery placed on said form, said contact edge being disposed above the upper surface of said clamp body when said clamp jaws are in their closed position;

mechanical means discrete from said form for raising said clamp means to a desired height; and mechanical clamp actuating means for moving said clamp jaws between its open and closed positions, said mechanical clamp actuating means being correlated with said mechanical clamp raising means to move said clamp jaws to their closed position after said upper surface of said clamp body has contacted a bottom of hosiery placed on said form and moved the bottom of the hosiery upward a distance.

* * * * *

UNITED STATES PATENT AND TRADEMARK OFFICE

CERTIFICATE OF CORRECTION

PATENT NO. : 4,421,259

DATED : December 20, 1983

INVENTOR(S) : James H. Sewell, Hans Gaede and Curtis R. Ritch

It is certified that error appears in the above—identified patent and that said Letters Patent is hereby corrected as shown below:

In the Abstract, line 10, after "until", "t" should be --it--;

Column 4, line 9, "button" should be --buttons--;

Column 5, line 23, "114" should be --144--; and

Claim 30, Column 12, line 12, "thereof" should be --thereon--.

Signed and Sealed this

*Twentieth* Day of *March 1984*

[SEAL]

*Attest:*

GERALD J. MOSSINGHOFF

*Attesting Officer*

*Commissioner of Patents and Trademarks*